US008120338B2

(12) United States Patent
Kawagishi et al.

(10) Patent No.: US 8,120,338 B2
(45) Date of Patent: Feb. 21, 2012

(54) DROPPER-TYPE REGULATOR

(75) Inventors: Norihiro Kawagishi, Tokyo (JP); Kazuyoshi Asakawa, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 561 days.

(21) Appl. No.: 12/326,947

(22) Filed: Dec. 3, 2008

(65) Prior Publication Data

US 2009/0153122 A1 Jun. 18, 2009

(30) Foreign Application Priority Data

Dec. 13, 2007 (JP) ..... 2007-322217

(51) Int. Cl.
*G05F 1/618* (2006.01)

(52) U.S. Cl. ..... 323/272; 323/269

(58) Field of Classification Search ..... 323/282–290, 323/266–269, 272–275; 363/16–20, 21.01
See application file for complete search history.

(56) References Cited

U.S. PATENT DOCUMENTS

| | | | | |
|---|---|---|---|---|
| 4,972,446 | A * | 11/1990 | Kennedy et al. | 377/47 |
| 5,648,718 | A * | 7/1997 | Edwards | 323/274 |
| 5,852,359 | A * | 12/1998 | Callahan et al. | 323/274 |
| 5,861,737 | A * | 1/1999 | Goerke et al. | 323/282 |
| 6,424,128 | B1 * | 7/2002 | Hiraki et al. | 323/268 |
| 6,469,480 | B2 * | 10/2002 | Kanakubo | 323/269 |
| 6,580,253 | B2 * | 6/2003 | Kanakubo et al. | 323/222 |
| 7,049,799 | B2 * | 5/2006 | Sugiura | 323/282 |

FOREIGN PATENT DOCUMENTS

| | | |
|---|---|---|
| JP | 2004-318339 | 11/2004 |
| JP | 2005-327027 | 11/2005 |

* cited by examiner

*Primary Examiner* — Rajnikant Patel
(74) *Attorney, Agent, or Firm* — Taft Stettinius & Hollister LLP

(57) ABSTRACT

A dropper-type regulator capable of providing a soft start function using a simple circuit configuration. An exemplary regulator includes a first FET having a relatively high current driving capability and a second FET having a relatively low current driving capability are provided in parallel between an input terminal and an output terminal. For a predetermined time immediately after power activation, only the second FET is driven, thereby preventing a large rush current. A switch circuit connected to the gate of the first FET is operated after the predetermined period of time, thereby supplying a driving voltage to the gate of the first FET.

21 Claims, 6 Drawing Sheets

DROPPER-TYPE REGULATOR

CROSS-REFERENCE TO RELATED APPLICATION

This application claims the benefit of Japanese Patent Application No. 2007-322217, filed Dec. 13, 2007, which is incorporated by reference.

BACKGROUND

The present invention relates to voltage regulators and, more particularly, to dropper-type regulators providing a soft start function.

Dropper-type regulators are typically used when it is desired to supply an output voltage lower than an input voltage. In some dropper-type regulators, an output transistor is used as a variable resistor, so that an input voltage is lowered to thereby maintain a stable output voltage. Dropper-type regulators may be configured to provide a so-called soft start function that smoothes the rise of the output voltage so that a high current upon power activation (known as an inrush current) may be prevented.

An example of a dropper-type regulator 100 having such a soft start function is illustrated in FIG. 1. An output transistor 1 is connected between an input terminal 102 and an output terminal 104, and a stabilization capacitor 106 is connected to the output terminal 104. The output voltage is divided by resistors 108 and 110, and a feedback voltage derived from a central connection point 112 of the resistors 108, 110 is connected to an inversion input terminal 114 of a differential amplifier 3. The differential amplifier 3 is configured to receive a reference voltage VREF at a non-inversion input terminal 116 and to supply an output voltage corresponding to a difference between the feedback voltage and the reference voltage VREF to a drive circuit 4 to provide voltage feedback, so that the output voltage of the regulator 100 is maintained relatively constant. Moreover, the drive circuit 4 is connected to a duty control circuit 5, which controls a duty ratio of a gate voltage of the output transistor 1 upon activation, so that the output transistor 1 is intermittently turned on/off, thereby providing a soft start function. See, e.g., Japanese Laid-Open Patent Application No. 2004-318339, which is incorporated by reference.

In another example which does not include the duty control circuit, a CR circuit (capacitor-resistor circuit, also known as an RC circuit for resistor-capacitor circuit) is inserted between the differential amplifier 3 and the reference voltage source VREF. The CR circuit reduces the rate of increase of the output voltage when the reference voltage rapidly increases upon power activation, thereby providing the soft start function. See, e.g., Japanese Patent Application Laid-Open No. 2005-327027, which is incorporated by reference.

However, the dropper-type regulator illustrated in FIG. 1 requires additional circuits for duty control which were not originally required in a basic regulator (such as an oscillator, a pulse width modulator, and a frequency sweep circuit) and, thus, the size of the circuit increases. Moreover, since it is typically necessary to change a pulse width modulation rate or a frequency sweep time whenever the capacitance of the output capacitor changes, a control circuit for such control is typically required. Similarly, in devices including a CR circuit, the sizes of the resistor and the capacitor comprising the CR circuit may need to be increased if the capacitance of the output capacitor changes. Thus, when a CR circuit is integrated into an integrated circuit ("IC"), the chip size may increase. As a result, it is difficult to set the circuit parameters with sufficient flexibility. Furthermore, it is typically difficult to design a device in which the output voltage is immediately OFF upon power OFF due to the influence of the CR circuit.

INTRODUCTION

Embodiments include a dropper-type regulator capable of providing a soft start function using a simple circuit configuration. An exemplary regulator includes a first FET having a relatively high current driving capability and a second FET having a relatively low current driving capability are provided in parallel between an input terminal and an output terminal. For a predetermined time immediately after power activation, only the second FET is driven, thereby preventing a large rush current. A switch circuit connected to the gate of the first FET is operated after the predetermined period of time, thereby supplying a driving voltage to the gate of the first FET.

More specifically, an exemplary dropper-type regulator for lowering an input voltage applied to an input terminal and supplying a substantially constant output voltage from an output terminal includes a first FET having a source and a drain connected to the input terminal and the output terminal, respectively; a second FET having a source and a drain connected to the source and the drain of the first FET, respectively, and having a current driving capability lower than that of the first FET; a driving voltage generation circuit capable of generating a driving voltage corresponding to the output voltage appearing at the output terminal to thereby supply the driving voltage to a gate of the second FET; and a switch circuit for selectively supplying the driving voltage to the gate of the first FET. Such an embodiment provides a dropper-type regulator with a soft start function using a relatively simple circuit configuration.

These and other features and advantages will become apparent to those skilled in the art upon consideration of the following detailed description of exemplary embodiments. The drawings are only to serve for reference and illustrative purposes, and are not intended to limit the scope of the disclosure.

BRIEF DESCRIPTION OF THE DRAWINGS

The detailed description refers to the following figures in which.

DETAILED DESCRIPTION

Figure 1:
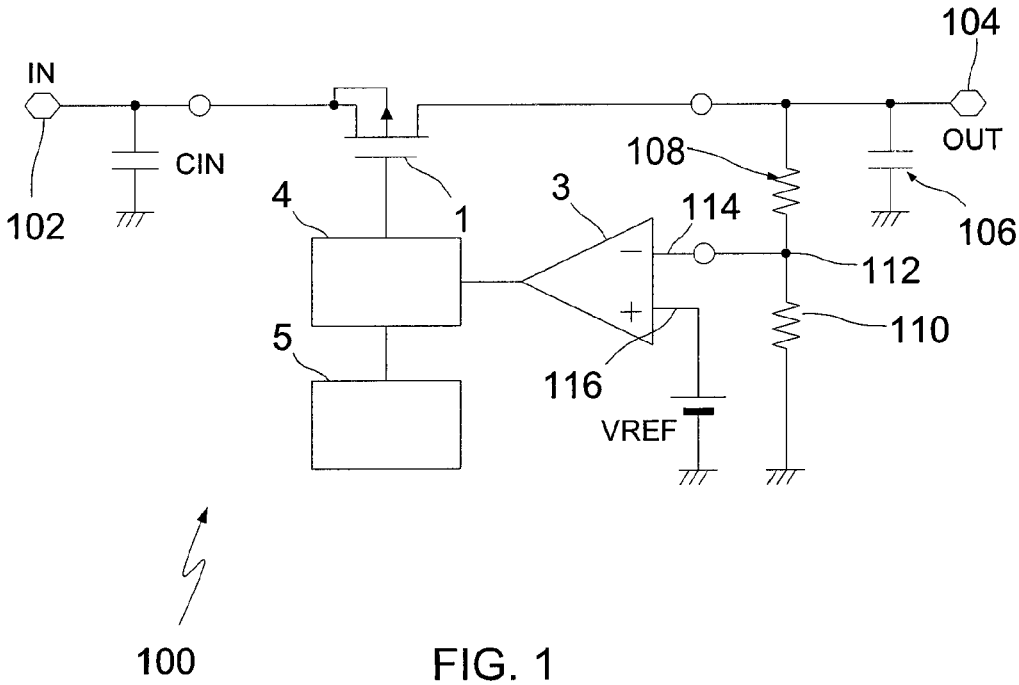
FIG. 1 PRIOR ART
FIG. 1 is a circuit block diagram illustrating a conventional dropper-type regulator having a soft start function.

A description of an exemplary embodiments are provided below with reference to the accompanying drawings. In the drawing figures, substantially the same or equivalent components or portions will be denoted by the same reference numerals.

Figure 2:
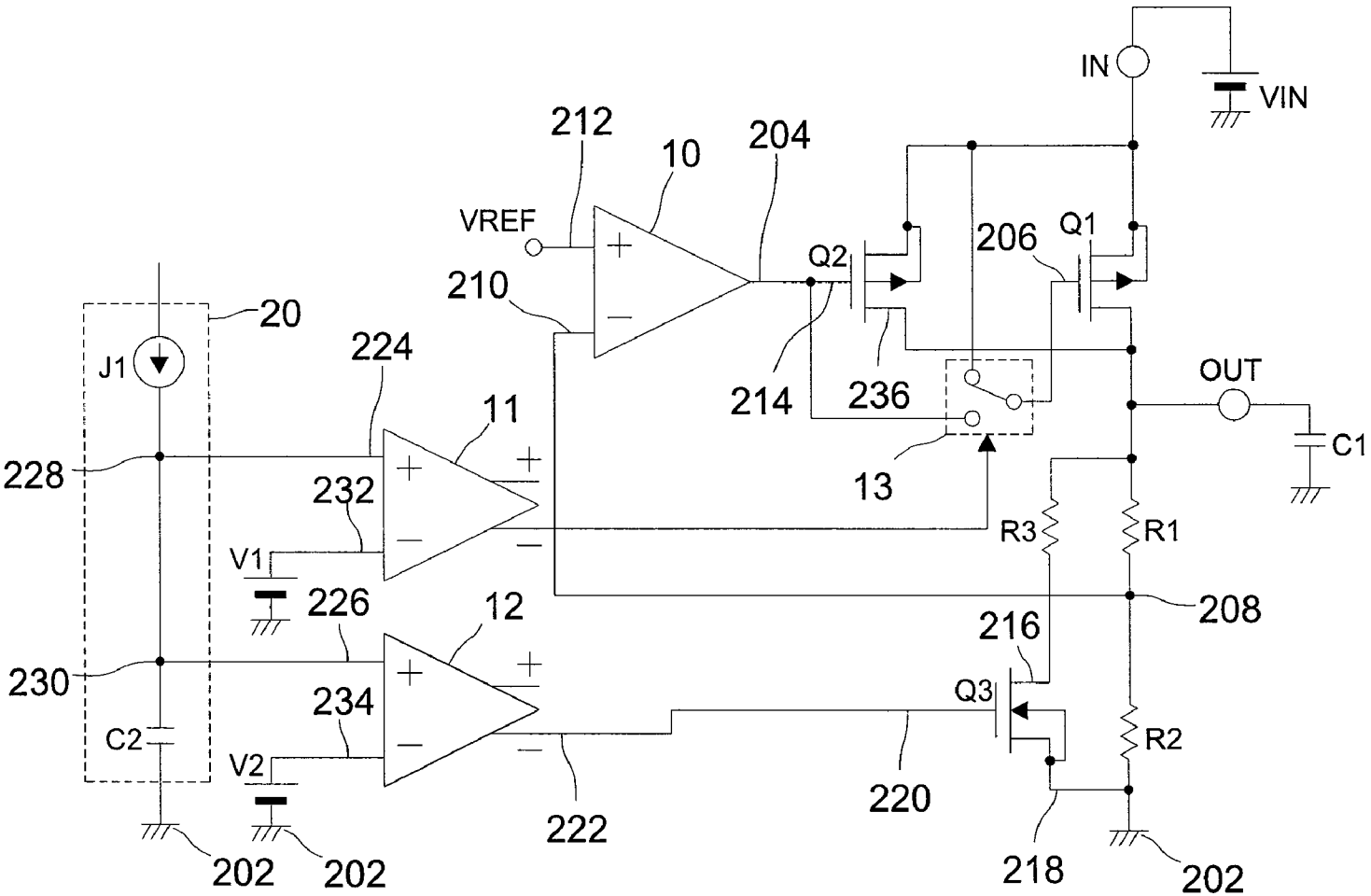
FIG. 2 is an equivalent circuit diagram illustrating the configuration of a first exemplary dropper-type regulator.

FIG. 2 is an equivalent circuit diagram illustrating the configuration of a first exemplary dropper-type regulator.

This dropper-type regulator is configured to generate a predetermined stabilized DC output voltage from a power supply voltage VIN applied from an external source to a power supply input terminal IN and to output the generated output voltage at an output terminal OUT. An output capacitor C1 for noise reduction is connected between the output terminal OUT and the ground 202. This regulator may be integrated into a semiconductor integrated circuit ("IC").

In the exemplary embodiment, a first output field effect transistor ("FET") Q1 and a second output FET Q2 are connected in parallel between the power supply input terminal IN and the output terminal OUT. The first output FET Q1 and the second FET Q2 may be P-channel MOSFETs (metal-oxide-semiconductor field-effect transistor), for example, and respective sources and drains of the FETs Q1, Q2 are connected to the power supply input terminal IN and the output terminal OUT, respectively. The second output FET Q2 has a gate width and a gate length smaller than those of the first FET Q1, and the current driving capability of the second output FET Q2 is lower than that of the first output FET Q1. That is, the second output FET Q2 has a smaller element size and is configured to flow a current smaller than that of the first output FET Q1, which has a larger element size, even when the same gate voltage is applied to the FETs Q1, Q2. A gate of the second output FET Q2 is connected to the output terminal 204 of a differential amplifier 10. A gate 206 of the first output FET Q1 is connected to a switch circuit 13, which selectively connects the gate 206 of the first output FED Q1 to either of the output terminal 204 of the differential amplifier 10 or the power supply voltage VIN in response to a switching operation of the switch circuit 13. An output voltage of a first comparator 11 is supplied to the switch circuit 13, so that the switching operation is performed in accordance with the output voltage.

In the exemplary embodiment, series-connected resistors R1 and R2 are connected between the output terminal OUT and the ground 202, and a feedback voltage derived from a central connection point 208 of the resistors R1, R2 is supplied to an inversion input terminal 210 of the differential amplifier 10. The differential amplifier 10 is configured to receive a predetermined reference voltage VREF at a non-inversion input terminal 212, to supply an output voltage corresponding to a difference between the feedback voltage from connection point 208 and the reference voltage VREF, as a FET driving voltage to the gate 214 of the second output FET Q2, and additionally to the gate 206 of the first output FET Q1 with intervention of the switch circuit 13. With such a configuration, the differential amplifier 10 is capable of driving the respective gates 206, 214 of the FETs Q1, Q2 so that the output voltage of the regulator becomes a predetermined voltage. Specifically, a feedback loop is formed by the output FETs Q1, Q2, the resistors R1, R2, and the differential amplifier 10. This arrangement provides negative feedback for the output voltage of the regulator, so that the output voltage is regulated.

In addition, in the exemplary embodiment, a charge pull-out FET Q3 and a resistor R3 are connected between the output terminal OUT and the ground 202. Specifically, the resistor R3 has one end connected to the output terminal OUT and the other end connected to a drain 216 of the charge pull-out FET Q3, which may be an N-channel MOSFET, for example. The source 218 of the charge pull-out FET Q3 is connected to the ground 202, and the gate 220 is connected to an output terminal 222 of a second comparator 12.

In the exemplary embodiment, the first comparator 11 and the second comparator 12 have respective non-inversion input terminals 224,226 which are connected to output terminals 228, 230 of an activation control circuit 20. The activation control circuit 20 is includes a current source circuit J1 and a capacitor C2. The current source circuit J1 is configured to generate a constant current upon activation of a power supply of the regulator, thereby charging capacitor C2. With this charging operation, an activation control voltage having a potential rising at a predetermined rate after power activation appears at the output terminals 228, 230 of the activation control circuit 20, which are connected between the capacitor C2 and the current source circuit J1.

In the exemplary embodiment, the activation control voltage is input to the non-inversion input terminals 224, 226 of the first comparator 11 and the second comparator 12. Moreover, the activation control voltage is configured to be set at a voltage corresponding to a desired rising time by appropriately adjusting the capacitance of the capacitor C2 or the current supplied by the current source circuit J1. Furthermore, a reference voltage V1 is input to an inversion input terminal 232 of the first comparator 11 and a reference voltage V2 is input to an inversion input terminal 234 of the second comparator 12. The first and second comparators 11, 12 are configured to compare the activation control voltage with the reference voltage V1 or V2 to provide an output signal of a high level when the activation control voltage is lower than the reference voltage V1 or V2, while providing an output signal of a low level when the activation control voltage is higher than the reference voltage V1 or V2. In this embodiment, reference voltage V1 is higher than reference voltage V2.

In the exemplary embodiment, the switch circuit 13 is configured to perform its switching operation such that the gate 206 of the first output FET Q1 is connected to the power supply voltage VIN via the power supply input terminal IN when the output of the first comparator 11 is high, while the gate 206 of the first FET Q1 is connected to the output 204 of the differential amplifier circuit 10 when the output of the first comparator 11 is low. Meanwhile, the charge pull-out FET Q3 is configured to enter into an OFF state when the output of the second comparator 12 is low and is configured to enter into an ON state when the output of the second comparator 12 is high.

Figure 3:
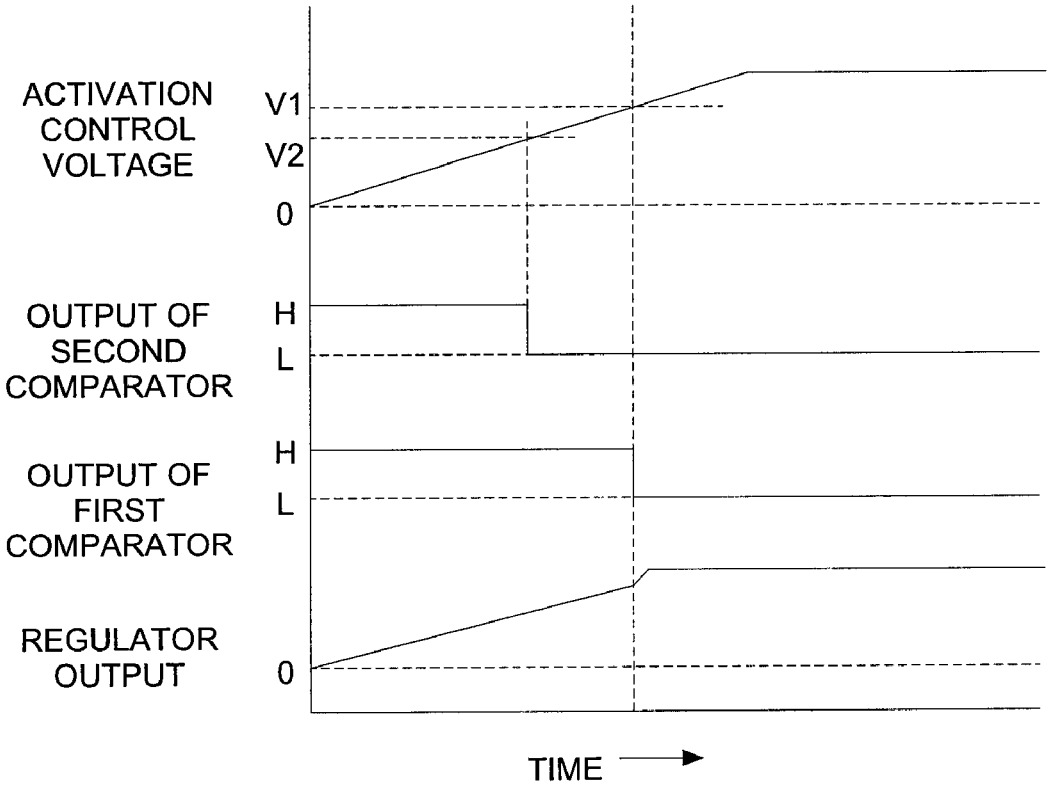
FIG. 3 is a timing chart illustrating the operation of the first exemplary dropper-type regulator.

The operation of the exemplary dropper-type regulator described above is provided with reference to the timing chart of FIG. 3. First, in an initial state immediately after the power activation of the regulator circuit, the output of the first comparator 11 is high, and, therefore, the switch circuit 13 connects the gate 206 of the first output FET Q1 to the power supply voltage VIN. For this reason, the first output FET Q1 is in an OFF state immediately after activation of the regulator. Since the second output FET Q2 is supplied with the driving voltage by the differential amplifier circuit 10 immediately after activation and negative feedback is not yet applied thereto, the second output FET Q2 is fully driven to enter into a completely ON state, thereby starting charging of the output capacitor C1. However, since the second FET Q2 has a small element size and small current driving capability as described above, the current flowing to the output capacitor C1 is limited, and a relatively long period of time is required for the capacitor C1 to become completely charged due to the low driving capability of the second FET Q2. For this reason, the output voltage of the regulator slowly increases, and, thus, a soft start function is provided. Furthermore, the output of the second comparator 12 is also high immediately after the activation of the regulator, and, therefore, the charge pull-out FET Q3 is turned ON immediately after the activation. Therefore, a portion of the output current flowing from the second output FET Q2 flows into the charge pull-out FET Q3, and, thus, the flow of current into the capacitor C1 is further suppressed. Moreover, the charge pull-out FET Q3 also has the function of draining charges which may have been overcharged into the capacitor C1.

Meanwhile, when the regulator circuit is activated, the current source circuit J1 begins charging the capacitor C2. Then, the charging voltage of capacitor C2 (i.e., the activation control voltage) increases at a constant rate, and when the activation control voltage exceeds the reference voltage V2, the second comparator 12 changes its output from high to low. When the output of the second comparator becomes low, the charge pull-out FET Q3 enters into an OFF state, and the diversion of current from the output capacitor C1 stops. Subsequently, when the charging of the capacitor C2 has proceeded further and the activation control voltage has exceeded the reference voltage V1, the first comparator 11 changes its output from high to low. When the output of the first comparator 11 has changed from high to low, the switch circuit 13 switches the gate 206 of the first output FET Q1 to the output 204 of the differential amplifier circuit 10. In this way, the gate 206 of the first output FET Q1 is supplied with the driving voltage output 204 from the differential amplifier circuit 10, and the output capacitor C1 is charged by an output current corresponding to the driving voltage. As described above, the first output FET Q1 has a larger element size and higher current driving capability than the second FET Q2 and is therefore capable of supplying a larger current. However, when the first output FET Q1 is in an ON state, since the output capacitor C1 may have some charges stored therein, and the output voltage of the regulator may have reached a voltage close to a target voltage, the inrush current may not flow into the output capacitor C1, and, thus, an abrupt rise in the output voltage may be prevented. In a normal state, both the first and second output FETs Q1, Q2 are driven and stabilization of the output voltage is attained.

As described above, in the exemplary dropper-type regulator, the regulator includes two output FETs Q1, Q2 having different current driving capabilities and that are configured such that only the output FET having the lower current driving capability (typically the one with the smaller element size) is driven immediately after power activation, while the output FET having the higher current driving capability (typically the larger element size) is driven when the output voltage has approached the target voltage, thus providing a soft start function with a relatively simple circuit configuration. Moreover, immediately after the activation, since the charge pull-out FET Q3 (which is connected to the output terminal OUT via resistor R3) is put into an ON state, it is possible to more effectively suppress the current flowing into the output capacitor C1.

Figure 4:
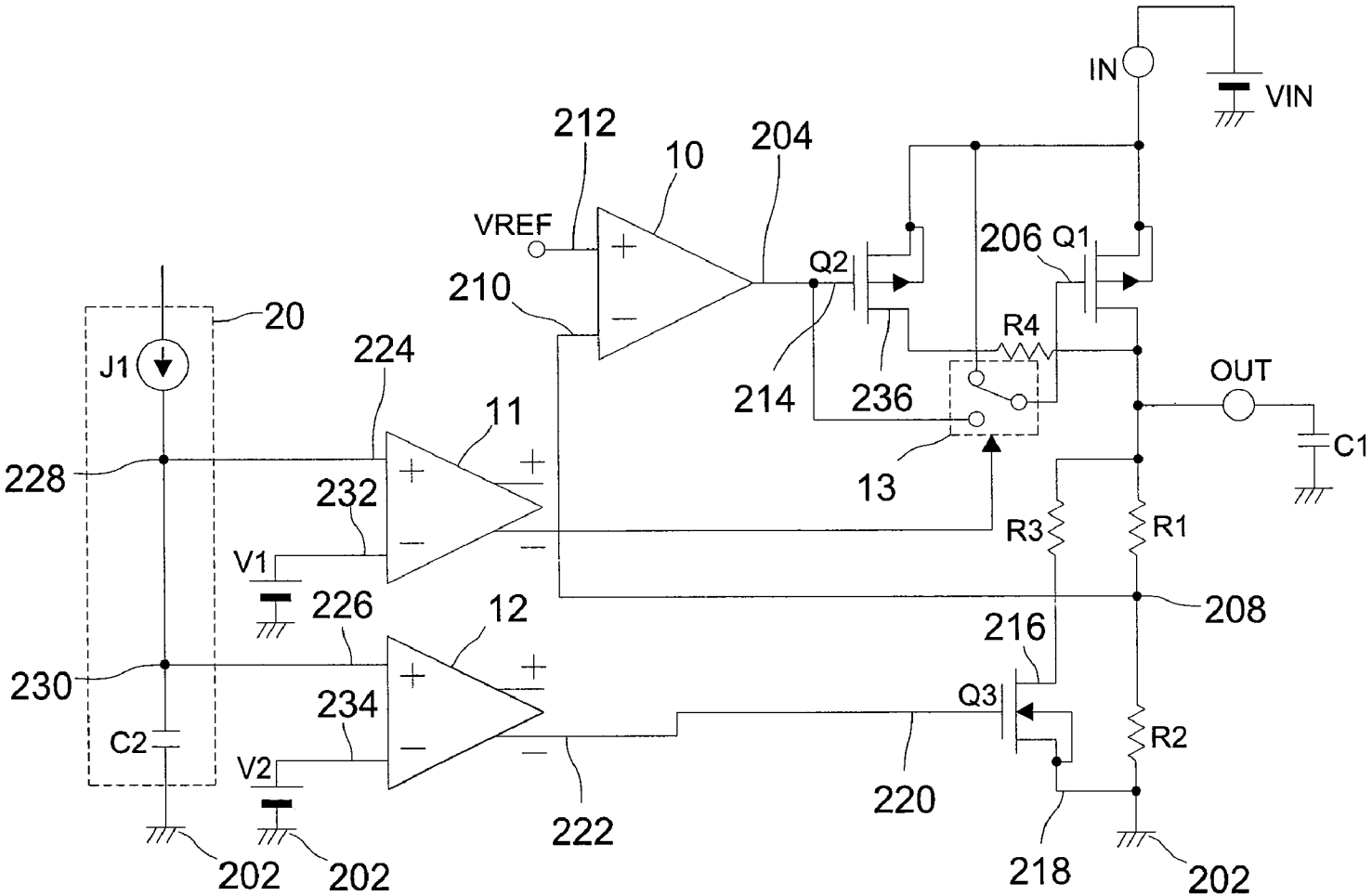
FIG. 4 is an equivalent circuit diagram illustrating the configuration of a second exemplary dropper-type regulator.

FIG. 4 is an equivalent circuit diagram illustrating a second exemplary dropper-type regulator. This dropper-type regulator has the same basic configuration as the first exemplary embodiment, except that a current limiting resistor R4 is connected between the drain 236 of the second output FET Q2 and the output terminal OUT. That is, the output current flowing from the second output FET Q2 charges the output capacitor C1 via the current limiting resistor R4. Other portions of the configuration are generally the same as those of the first exemplary embodiment, and thus, a redundant description thereof is omitted.

The operation of the dropper-type regulator of the second exemplary embodiment is substantially the same as that of the first exemplary embodiment. Specifically, in an initial state immediately after the power activation of the regulator circuit, the output of the first comparator 11 is high, and, therefore, the switch circuit 13 connects the gate 206 of the first output FET Q1 to the power supply voltage VIN. For this reason, the first output FET Q1 is in an OFF state immediately after activation of the regulator. Since the second output FET Q2 is supplied with a driving voltage by the differential amplifier circuit 10 immediately after activation and negative feedback is not yet applied thereto, the second output FET Q2 is fully driven into a completely ON state, thereby starting charging of the output capacitor C1. In this case, the output current flowing out from the second output FET Q2 is decreased due to the effect of the added current limiting resistor R4 and the low current driving capability of the second output FET Q2. Therefore, the flow of the current into the output capacitor C1 is further suppressed, and, thus, it is possible to further smooth the rising transition of the output voltage of the regulator. Furthermore, the output of the second comparator 12 is also high immediately after the activation, and, therefore, the charge pull-out FET Q3 is driven ON immediately after the activation, and the current flowing into the output capacitor C1 is suppressed. Meanwhile, when the regulator circuit is activated, the current source circuit J1 is begins charging capacitor C2. Subsequent operations are the same as those of the first exemplary embodiment, and, thus, a redundant description is omitted.

In this way, by adding the current limiting resistor R4 on the output current path of the second output FET Q2, it is possible to further reduce a high inrush current upon activation of the regulator.

Figure 5:
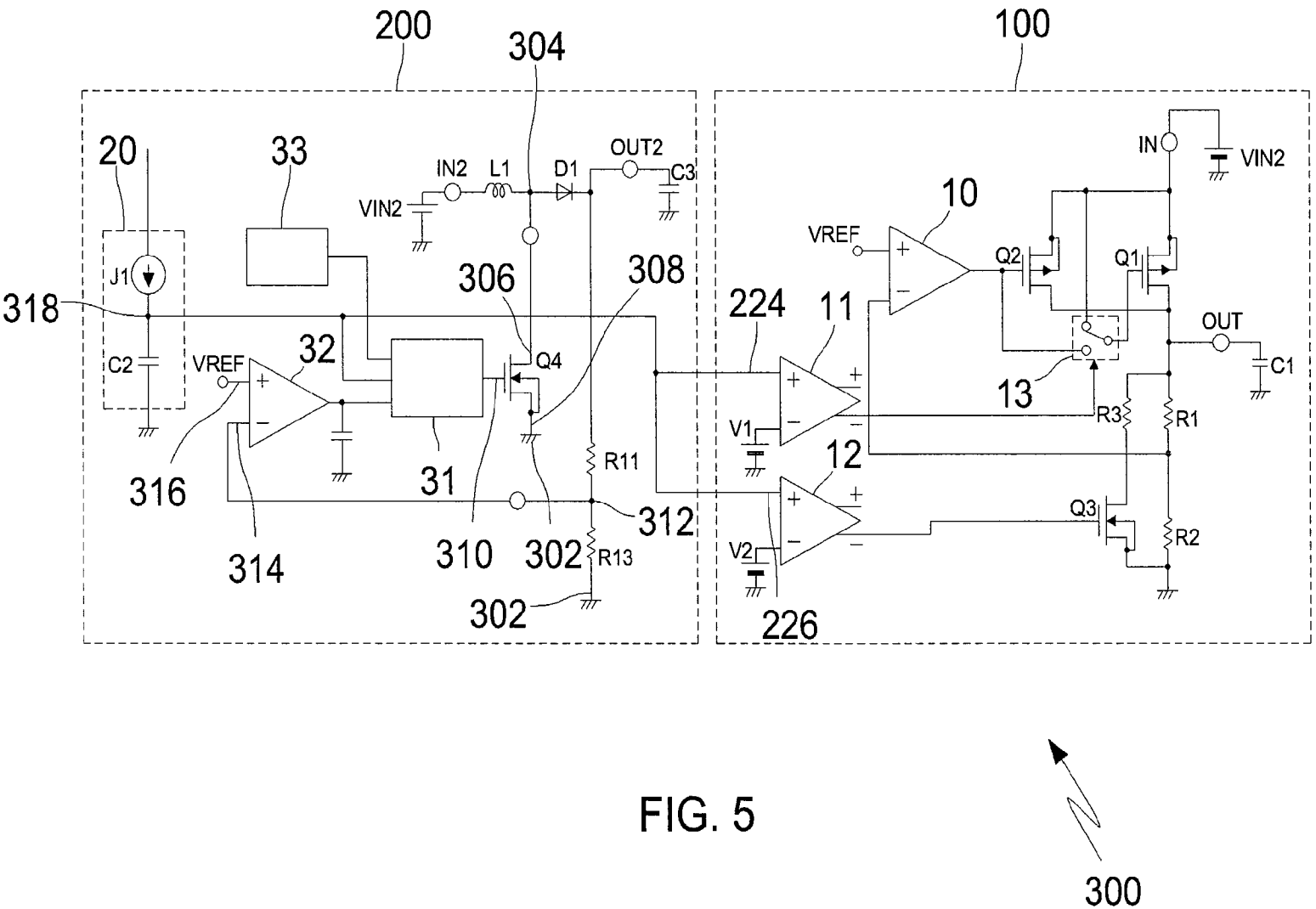
FIG. 5 is an equivalent circuit diagram illustrating an exemplary configuration of an power supply system including a dropper-type regulator and a switching regulator.

FIG. 5 is an equivalent circuit diagram illustrating an exemplary configuration of a power supply system 300 including dropper-type regulator 100 according to the first or second exemplary embodiment and a switching regulator 200. The switching regulator 200 is a booster-type DC/DC converter configured to boost a power supply voltage VIN2 applied from an external source via a power supply input terminal IN2 to supply a predetermined output voltage at an output terminal OUT2. In an embodiment, the dropper-type regulator 100 and the switching regulator 200 are integrated into a single semiconductor IC such that either one or both of them can be used.

In the exemplary switching regulator 200, an inductor L1 is connected to a DC input voltage VIN2 at one end, and the anode of a diode D1 is connected to the other end of the inductor L1. The cathode of the diode D1 is connected to the output terminal OUT2 of the switching regulator 200. An output capacitor C3 is connected between the output terminal OUT2 and the ground 302 for noise reduction. A connection point 304 of the inductor L1 and the diode D1 is connected to the drain 306 of an output FET Q4, which may be an N-channel MOSFET, for example. The output FET Q4 has its source 308 connected to the ground 302 and its gate 310 connected to a drive circuit 31. The drive circuit 31 is configured to generate a pulsating driving voltage for driving the output FET Q4. The output FET Q4 repeatedly turns on and off in accordance with the driving voltage of the drive circuit 31 such that stabilization of the output voltage is attained.

In the exemplary embodiment, series resistors R11 and R12 are connected between the output terminal OUT2 and the ground 302, and a feedback voltage derived from a central connection point 312 of the resistors is supplied to an inversion input terminal 314 of a differential amplifier 32. The differential amplifier 32 is configured to receive a predetermined reference voltage VREF at a non-inversion input terminal 316. The differential amplifier 32 generates an output voltage corresponding to a difference between the feedback voltage and the reference voltage VREF, and to supply the generated output voltage to the drive circuit 31. The drive circuit 31 also receives an output signal of an oscillator 33 capable of generating a triangular wave and an activation control voltage generated by an activation control circuit 20. The activation control circuit 20 includes a current source circuit J1 and a capacitor C2, for example. The current source circuit J1 is configured to generate a constant current upon activation of a power supply of the regulator to thereby charge the capacitor C2. With this charging operation, an activation control voltage rising at a predetermined rate after power activation appears at the output terminal 318 of the activation control circuit 20, which is the connection point of the capacitor C2 and the current source circuit J1. The activation control voltage generated by the activation control circuit 20 is connected not only to the drive circuit 20, but also to non-inversion input terminals 224, 226 of the first comparator 11 and the second comparator 22 of the dropper-type regulator 100.

Figure 6:
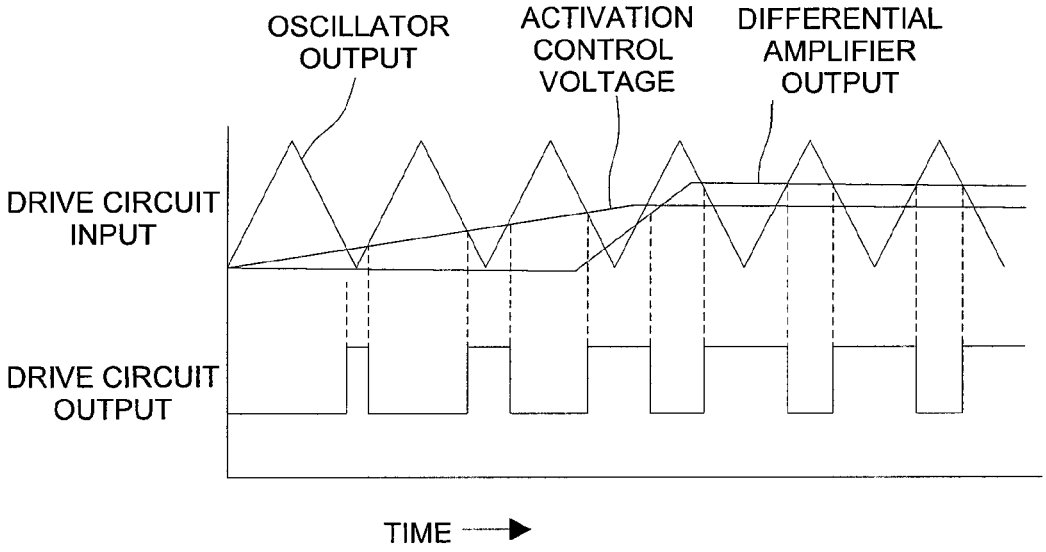
FIG. 6 is a timing chart illustrating operation of an exemplary switching regulator.

A description of the operation of the exemplary power supply system 300 having the above-described configuration refers to FIG. 6 which illustrates an input/output waveform of the drive circuit 31. As described above, the drive circuit 31 is supplied with the triangular wave generated by the oscillator 33, the activation control voltage generated by the activation control circuit 20, and the output voltage of the differential amplifier circuit 32. The drive circuit 31 includes a three-input comparator and is configured to produce an output signal of a low level when the voltage of the triangular wave supplied from the oscillator 33 is higher than either the activation control voltage or the output voltage of the differential amplifier 32, while producing an output signal of a high level when the voltage of the triangular wave is lower than either the activation control voltage or the output voltage of the differential amplifier 32, and to supply the output signal as a driving voltage to the gate of the output FET Q4. By such operation of the drive circuit 31, the output voltage of the drive circuit has a short high level period immediately after activation and the high level period increases with time, as illustrated in FIG. 6, so that the output voltage is eventually maintained at a constant duty ratio. The output FET Q4 is in an ON state only when the output voltage of the drive circuit 31 is high and is in an OFF state when it is low. The output FET Q4 repeats its turning ON/OFF operation in accordance with the driving voltage supplied from the drive circuit 31, whereby the output voltage of the switching regulator 200 is maintained at a constant voltage. Immediately after the power activation, since the high level period of the driving voltage is short, the ON period of the output FET Q4 is short, and, thus, the switching regulator 200 is provides a soft start function.

In the exemplary embodiment, since the activation control voltage generated by the activation control circuit 20 is also supplied to the non-inversion input terminals 224, 226 of the first and second comparators 11,12 of the dropper-type regulator 100, a soft start function of the dropper-type regulator 100 is attained. The operation of the dropper-type regulator 100 is the same as those of the first exemplary embodiment, and, thus, a redundant description thereof is omitted. In some embodiments, a single activation control circuit 20 may shared by a plurality of regulator circuits, thus potentially simplifying the circuit configuration.

In the above descriptions, although the activation control voltage by the activation control circuit 20 has been assumed to be generated by a charging voltage of a capacitor C2, the activation control voltage may be generated by a discharging voltage of the capacitor C2. In such a case, it may be necessary to invert a polarity of the input terminals 224, 226, 232, 234 of each of the comparators 11, 12 from the polarity described above.

While exemplary embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages of the may exist even though they may not have been explicitly discussed herein.

What is claimed is:

1. A regulator comprising:

a first transistor including a first source connected to a first input terminal and a first drain connected to a first output terminal;

a second transistor including a second source connected to the first source and a second drain connected to the first drain, the second transistor having a current driving capability lower than a current driving capability of the first transistor;

a driving voltage generation circuit configured to generate a first driving voltage corresponding to a first output voltage appearing at the first output terminal, the first driving voltage being supplied to a gate of the second transistor; and a switch device configured to selectively supply the first driving voltage to a gate of the first transistor while the first driving voltage is also supplied to the gate of the second transistor.

2. The regulator of claim 1, wherein the switch device is configured to supply the first driving voltage to the gate of the first transistor after a first predetermined period of time has elapsed after activation of the regulator.

3. The regulator of claim 2, wherein the switch device includes an activation control circuit configured to generate an activation control voltage that varies over time after activation of the regulator;

a first comparator configured to supply a first comparator output at a first voltage when the activation control voltage is less than a first predetermined threshold and at a second voltage when the activation control voltage is greater than the first predetermined threshold; and a switch circuit operatively connected to the first comparator and configured to receive the comparator output, the switch circuit being configured to selectively connect the gate of the first transistor to the first driving voltage based upon receipt of one of the first voltage and the second voltage.

4. The regulator of claim 3, wherein the second transistor has an element size smaller than an element size of the first transistor.

5. The regulator of claim 4, further comprising a third transistor connected to the first output terminal and configured to selectively divert a portion of an output current supplied to the first output terminal; and a driving circuit configured to drive the third transistor into an ON state for a second predetermined period of time after activation of the regulator.

6. The regulator of claim 5, wherein the driving circuit includes a second comparator configured to supply a second comparator output including a third voltage when the activation voltage is less than a second predetermined threshold and a fourth voltage when the activation control voltage is greater than the second predetermined threshold.

7. The regulator of claim 6, further comprising a current limiting resistor provided in a current path between the second transistor and the first output terminal.

8. The regulator of claim 7, wherein the regulator is integrated into a semiconductor integrated circuit.

9. The regulator of claim 1, wherein the second transistor has an element size smaller than an element size of the first transistor.

10. The regulator of claim 9, further comprising a current limiting resistor provided in a current path between the second transistor and the first output terminal.

11. The regulator of claim 9, further comprising a third transistor connected to the first output terminal and configured to selectively divert a portion of an output current supplied to the first output terminal; and a driving circuit configured to drive the third transistor into an ON state for a second predetermined period of time after activation of the regulator.

12. The regulator of claim 11, wherein the driving circuit includes a second comparator configured to supply a second comparator output including a third voltage when the activation voltage is less than a second predetermined threshold and a fourth voltage when the activation control voltage is greater than the second predetermined threshold.

13. The regulator of claim 11, further comprising a current limiting resistor provided in a current path between the second transistor and the first output terminal.

14. The regulator of claim 1, further comprising a third transistor connected to the first output terminal and configured to selectively divert a portion of an output current supplied to the first output terminal; and a driving circuit configured to drive the third transistor into an ON state for a second predetermined period of time after activation of the regulator.

15. The regulator of claim 14, wherein the driving circuit includes a second comparator configured to supply a second comparator output including a third voltage when the activation voltage is less than a second predetermined threshold and a fourth voltage when the activation control voltage is greater than the second predetermined threshold.

16. The regulator of claim 14, further comprising a current limiting resistor provided in a current path between the second transistor and the first output terminal.

17. The regulator of claim 1, further comprising a current limiting resistor provided in a current path between the second transistor and the first output terminal.

18. The regulator of claim 1, wherein the regulator is integrated into a semiconductor integrated circuit.

19. A power supply system comprising:

a dropper-type regulator including a first transistor including a first source connected to a first input terminal and a first drain connected to a first output terminal, a second transistor including a second source connected to the first source and a second drain connected to the first drain, the second transistor having a current driving capability lower than a current driving capability of the first transistor, a driving voltage generation circuit configured to generate a first driving voltage corresponding to a first output voltage appearing at the first output terminal, the first driving voltage being supplied to a gate of the second transistor, and a switch device configured to supply the first driving voltage to a gate of the first transistor after a first predetermined period of time has elapsed after activation of the regulator, the switch device including an activation control circuit configured to generate an activation control voltage that varies over time after activation of the regulator, a first comparator configured to supply a first comparator output at a first voltage when the activation control voltage is less than a first predetermined threshold and at a second voltage when the activation control voltage is greater than the first predetermined threshold, and a switch circuit operatively connected to the first comparator and configured to receive the comparator output, the switch circuit being configured to selectively connect the gate of the first transistor to the first driving voltage based upon receipt of one of the first voltage and the second voltage; and a switching regulator including a series circuit including an inductor connected together in series with a diode at a connection point, the series circuit being connected a second input terminal and a second output terminal, a third transistor connected to the connection point, and a driving circuit configured to supply a driving voltage to a gate of the third transistor, wherein the driving circuit is configured to generate the driving voltage with a duty ratio corresponding to the activation control voltage.

20. The power supply system according to claim 19, wherein dropper-type regulator and the switching regulator are integrated in a single semiconductor integrated circuit.

21. A regulator comprising:

a first MOSFET including a first source connected to a first input terminal and a first drain connected to a first output terminal;

a second MOSFET including a second source connected to the first source and a second drain connected to the first drain, the second MOSFET having a current driving capability lower than a current driving capability of the first MOSFET;

a driving voltage generation circuit having a driving voltage output in constant electrical communication with a gate of the second MOSFET, the driving voltage generation circuit configured to generate a first driving voltage corresponding to a first output voltage appearing at the first output terminal, where the first driving voltage is supplied to the gate of the second MOSFET; and, a switch device configured to selectively supply the first driving voltage to a gate of the first MOSFET.

* * * * *